United States Patent [19]

Sorensen et al.

[11] 4,000,843

[45] Jan. 4, 1977

[54] DIE CUT CORNER PAD

[75] Inventor: Wayne H. Sorensen, St. Paul; John F. Sorenson, Minneapolis, both of Minn.

[73] Assignee: Hoerner Waldorf Corporation, St. Paul, Minn.

[22] Filed: May 7, 1976

[21] Appl. No.: 684,276

[52] U.S. Cl. ..... 229/14 C; 229/DIG. 1; 206/320

[51] Int. Cl.[2] ..... B65D 85/30; B65D 85/48

[58] Field of Search ..... 229/14 C, DIG. 1; 206/320, 321, 325, 326

[56] References Cited

UNITED STATES PATENTS

| | | | |
|---|---|---|---|
| 2,885,139 | 5/1959 | Werner et al. | 229/14 C |
| 2,896,833 | 7/1959 | Markham | 229/14 C |
| 3,061,166 | 10/1962 | Deeren et al. | 229/14 C |
| 3,086,689 | 4/1963 | Wiedenmeier | 229/14 C |
| 3,319,867 | 5/1967 | Vrana | 229/14 C |
| 3,349,984 | 10/1967 | Halko, Jr. | 229/DIG. 1 |
| 3,362,609 | 1/1968 | Freedy | 229/14 C |
| 3,655,112 | 4/1972 | Jeffers | 229/14 C |
| 3,918,580 | 11/1975 | Poggiali | 206/320 |
| 3,957,196 | 5/1976 | Kellerman | 206/326 |

*Primary Examiner*—Davis T. Moorhead
*Attorney, Agent, or Firm*—Jerry F. Best

[57] ABSTRACT

A self-locking outside corner pad of sheet material and adapted for use with thin rectangular objects such as window frames or doors. The pads have adequate thickness and suspension structure to allow stacking, even without an outer sleeve.

2 Claims, 10 Drawing Figures

DIE CUT CORNER PAD

BACKGROUND OF THE INVENTION

1. Field of the Invention

This disclosure relates generally to corner protectors made from paperboard or the like, and more particular to those adapted for use with rectangular objects such as windows or doors.

2. Description of the Prior Art

Pads of the type described have typically been simple multiple folds of scored sheets to provide satisfactory thickness in six sections as shown in U.S. Pat. No. 2,896,833 to Markham. Other designs employ multiple materials such as in U.S. Pat. No. 2,885,139 to Werner et al. There is a need for a lightweight, self-locking pad of one material which is easy to assemble yet provides improved protection for the corners of objects of the general character described.

SUMMARY OF THE INVENTION

A one-piece corner pad with double thickness side walls and hollow cells at right angles to fit on the corner of a window frame or door.

DETAILED DESCRIPTION OF THE PREFERRED EMBODIMENT

Figure 2:
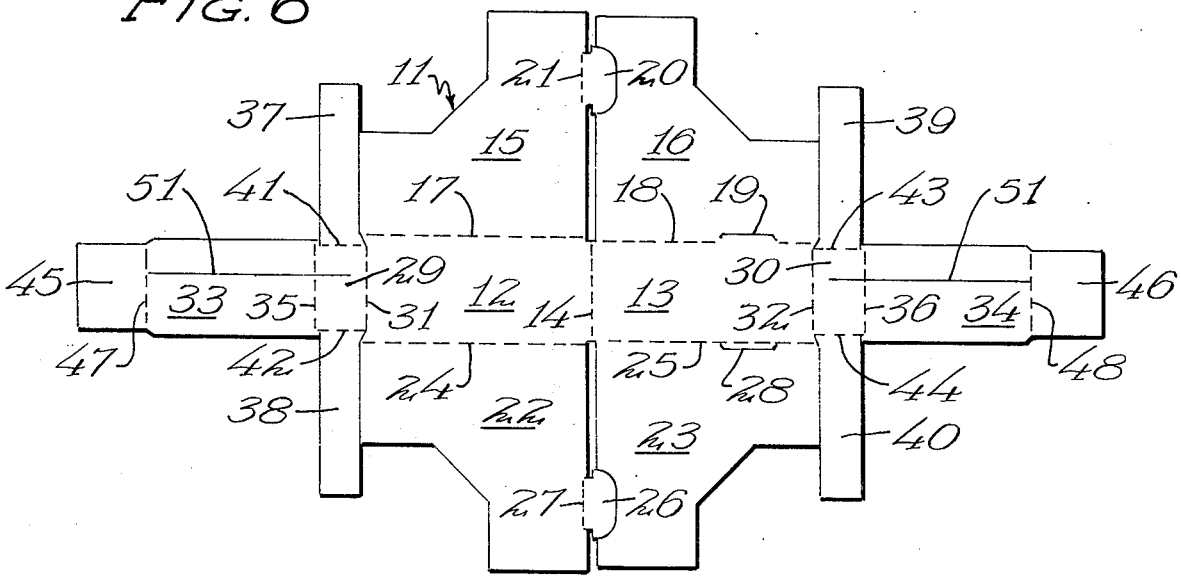
FIG. 2 is a plan view of a blank adapted to be erected into a pad similar to that shown in FIG. 1.
Figure 7:
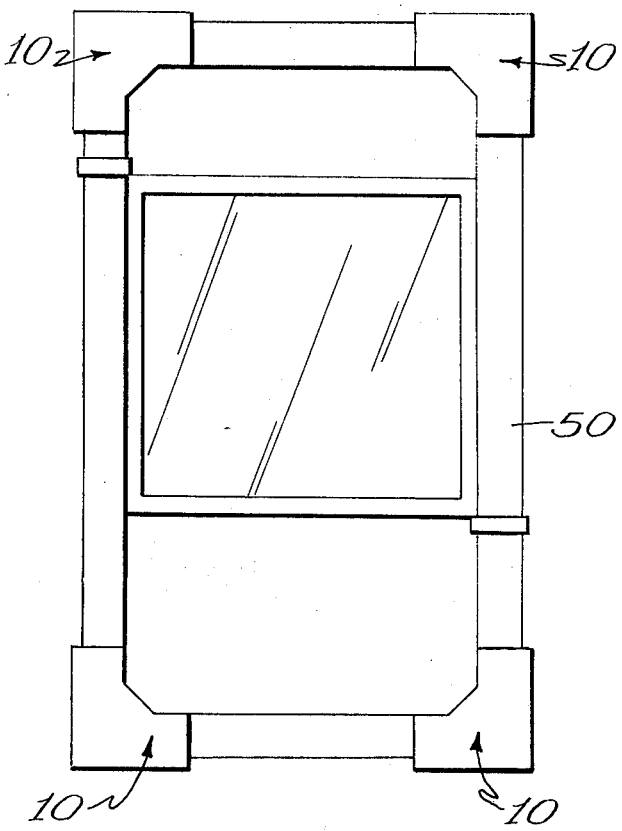
FIG. 7 is a plan view of a window frame fitted with pads such as those shown in FIG. 1.
Figure 9:
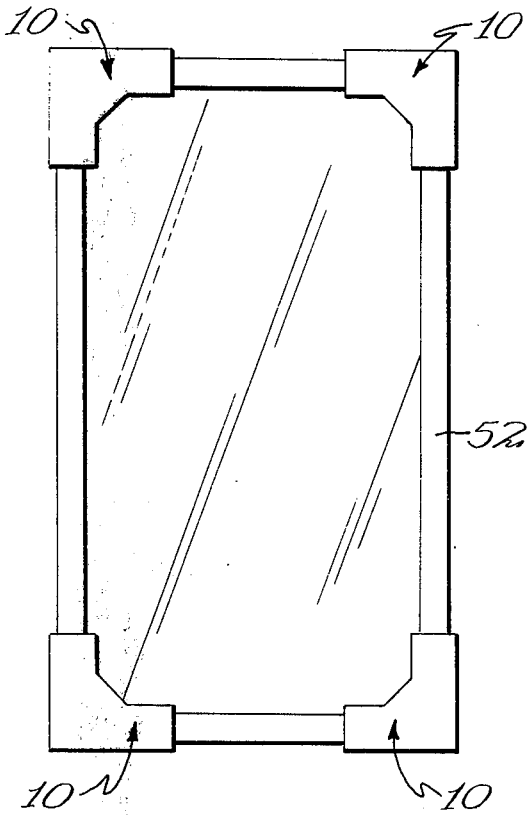
FIG. 9 is a plan view of an alternate embodiment showing a window frame with four corner pads fitted into recess slots in the pad.

This invention is for a pad which has a particular structure and configuration so that it may be used on the outside corners of rectangular objects to be shipped such as mirrors, doors, window frames, or other similar objects where protection must be afforded not only from blows on the edge or corner of the object but also to the sides near the corner where the pad may be located. The pad 10 is erected from a blank 11 which is shown generally in FIG. 2 and which is manufactured from foldable sheet-like material such as corrugated paperboard and has two rectangular outer wall panels

Figure 1:
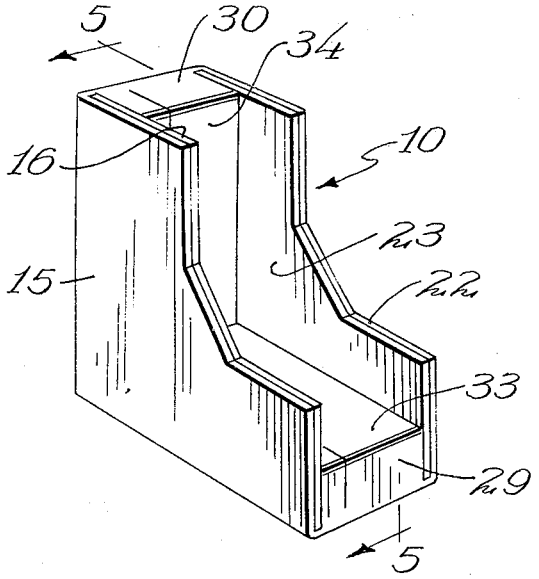
FIG. 1 is a perspective view of an assembled pad embodying the present invention.
Figure 3:
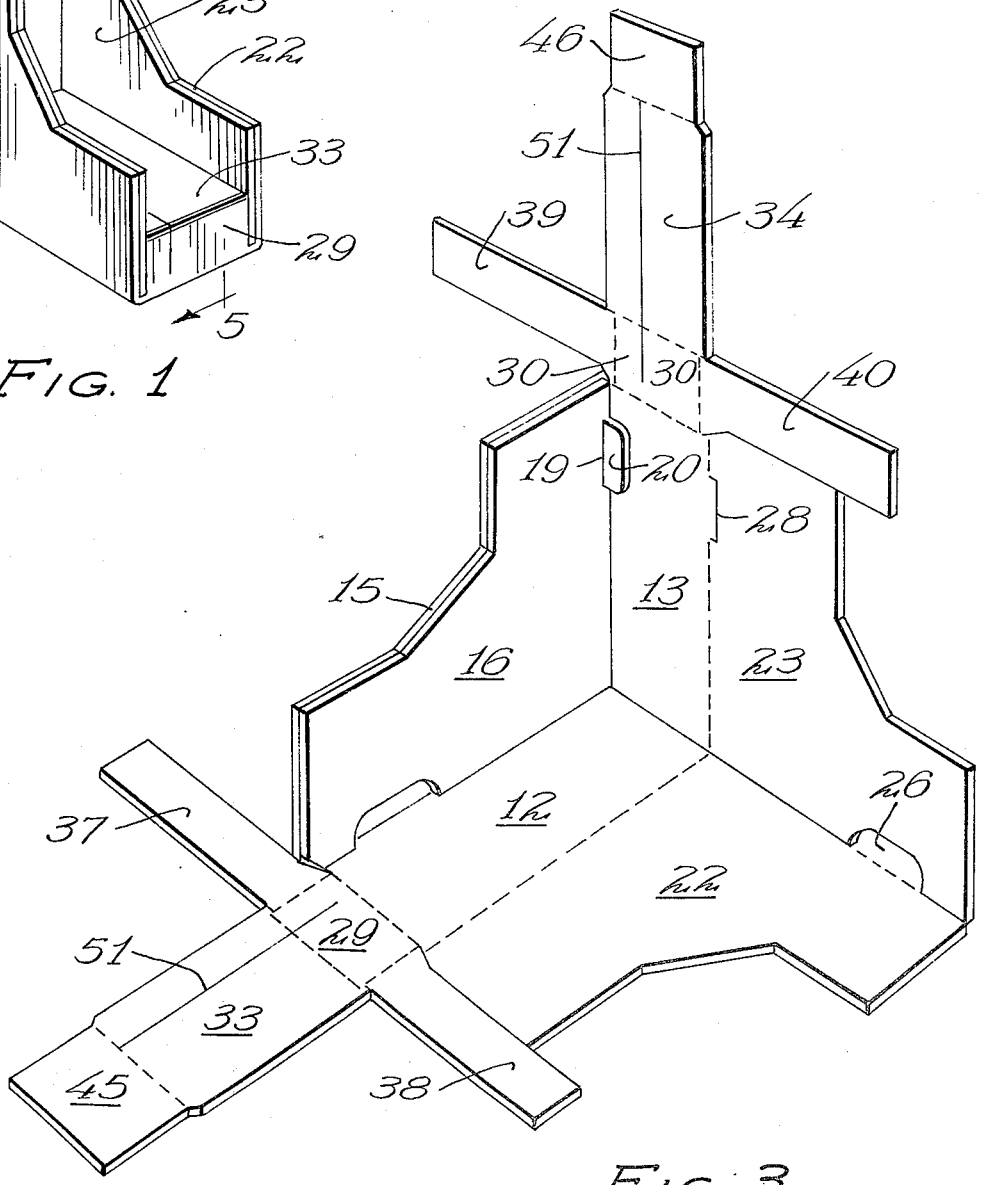
FIG. 3 is a perspective view of the blank shown in FIG. 2 partially erected and illustrating the assembly of the relative parts of the blank.

12 and 13 which are separated by a vertical fold line 14 and are adapted to lie at right angles to one another as can be seen best in FIG. 3. First and second side wall panels 15 and 16 are connected to the outer wall panels 12 and 13 along horizontal fold lines 17 and 18, respectively. These side wall panels are adapted to lie in overlapping relationship as seen in FIG. 3 to provide a double thickness side wall for the pad 10.

Although other techniques may be used, the particular embodiment shown illustrates the use of a U-shaped line cut 19 in the horizontal fold line 18 which is adapted to receive a locking tab 20 which is hingedly connected to the vertical edge of the side wall 15 along a short fold line 21 and projects into the adjacent side wall 16, the tab being die cut therefrom. It may be seen in FIG. 3 that when the outer panels 12 and 13 are folded into right angle relationship and the side walls 15 and 16 are placed in overlapping relationship, the locking tab 20 serves to hold the assembly in that position.

A similar structure is located on the opposite side of the two outer wall panels 12 and 13 and include side wall panels 22 and 23 connected along hinge lines 24 and 25 with a locking tab 26 connected along a hinge line 27 and adapted to be inserted through a line cut 28 in the fold line 25. At the outer lateral edges of the two adjacent outer wall panels 12 and 13 are rectangular spacer panels 29 and 30 connected along vertical hinge lines 31 and 32. The spacer panels 29 and 30 are positioned at right angles in the final folded configuration to the adjacent outer wall panels 12 and 13, respectively. The purpose of these spacer panels 29 and 30 is to position the inner wall panels 33 and 34, which are connected along vertical fold lines 35 and 36 from the adjacent parallel outer wall panel 12 or 13, respectively.

Figure 4:
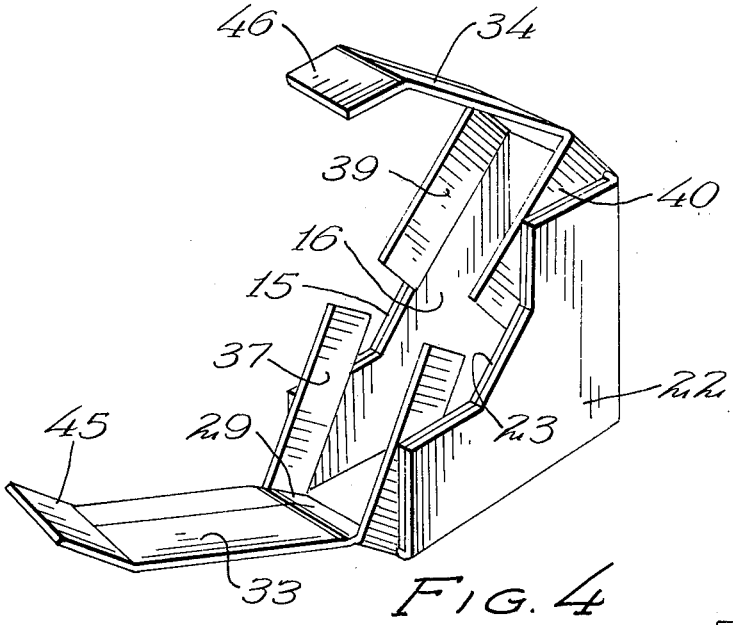
FIG. 4 is a perspective view of the pad further illustrating the relative position of the individual parts of the blank shown in FIG. 2.
Figure 6:
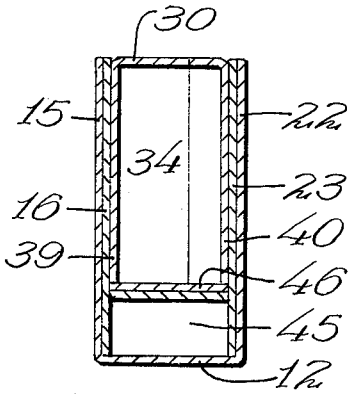
FIG. 6 is a sectional elevational view of a portion of the pad shown in FIGS. 1 and 5 taken along section lines 6—6 in FIG. 5.
Figure 5:
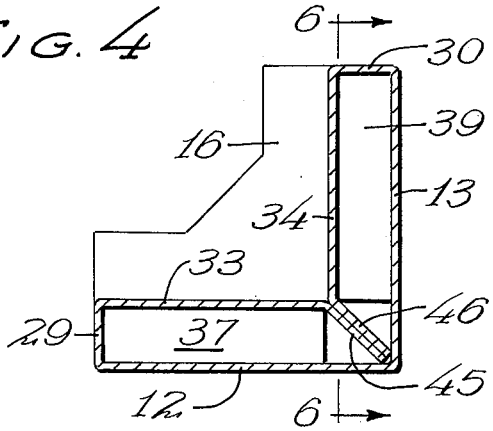
FIG. 5 is a side elevation section view of the pad shown in FIG. 1 taken along section lines 5—5.

Connected to the top and bottom edges of the spacer panels 29 and 30 along parallel fold lines are spacer tabs 37, 38, 39 and 40. The top and bottom edges of the two spacer panels 29 and 30 are inset slightly so that the fold lines 41, 42, 43 and 44 are slightly inside the spacing of the fold lines 17, 24 and 18 and 25 which allows these spacer tabs as seen in FIG. 4 to be positioned on the inside of the side walls to provide additional strength and support to the inner walls 33 and 34 which lie on top of those spacer tabs. Additional rigidity and the final locking feature is obtained with an additional pair of flaps 45 and 46 which are connected to the outermost lateral edges of the blank along vertical fold lines 47 and 48 and come together in diagonal abutting relationship as seen best in FIG. 5 to lock the inner wall panels in position and provide additional strength to the structure.

Figure 8:
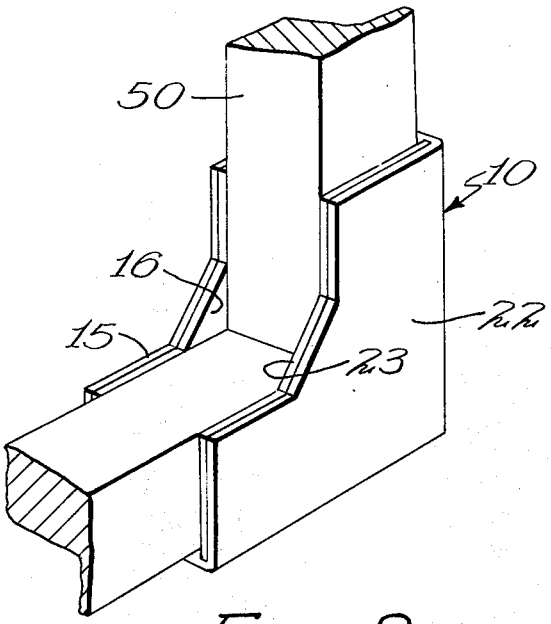
FIG. 8 is a perspective view of one of the pads and a portion of the frame shown in FIG. 7 more closely illustrating the relationship between the frame and the pad.
Figure 10:
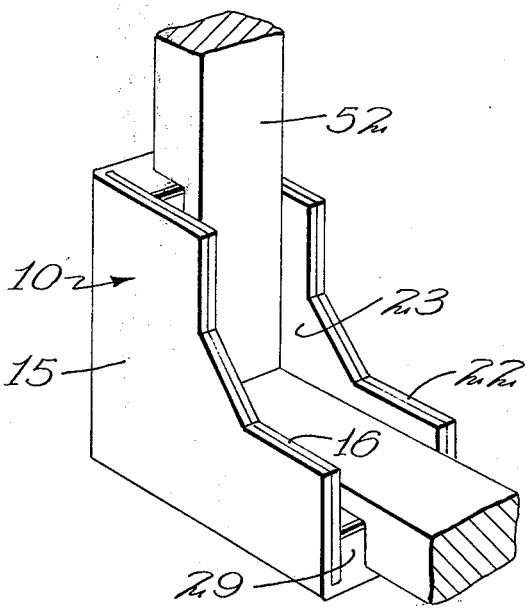
FIG. 10 is a perspective view of a portion of the window frame shown in FIG. 9 more closely illustrating the position of the frame into the recessed areas of the pad.

It should be noted that where a particular frame crossection includes a narrow flange, such as 49 on the window frame 50, seen best in FIG. 8, a slot 51 may be formed in each of the two inner wall panels 33 and 34 to accommodate that flange. Alternatively, the inner wall panels 33 and 34 may be notched to permit the frame 52 as seen in FIG. 10 to fit into the pad 10 and give even greater protection from the sides of the pack.

We claim:

1. A blank made of corrugated paperboard or similar sheet-like material and adapted to be erected into a right angle outside corner pad, said blank comprising:

a pair of rectangular outer wall panels having horizontal top and bottom edges and vertical lateral edges, said outer wall panels hingedly connected along adjacent lateral edges;

each of said outer wall panels having hingedly attached along the top and bottom edges thereof first and second side wall panels, respectively;

a rectangular spacer panel hingedly attached along the outer lateral edge of each of said outer wall panels, said spacer panels extending vertically a distance substantially equal to the vertical extent of said outer wall panels;

vertically extending spacer tabs hingedly attached to the top and bottom edges of each of said rectangular spacer panels;

a rectangular inner wall panel hingedly connected to the outside lateral edge of each of said rectangular spacer panels, the vertical extent of each of said inner wall panels being approximately equal to said outer wall panels; and a rectangular locking flap hingedly attached to the outer lateral edge of each of said inner wall panels.

2. An outside corner pad made of corrugated paperboard or similar sheet-like material, said pad comprising:

a pair of rectangular outer wall panels, hingedly connected along juxtaposed lateral edges and oriented in perpendicular relationship to each other;

each side edge of said outer wall panels having attached thereto side wall panels, said side wall panels from adjacent sides of each of said outer wall panels being arranged in overlapping face-to-face relationship in a plane perpendicular to each of said outer wall panels;

a rectangular spacer panel hingedly connected to each outer lateral edge of each of said outer wall panels with each spacer panel being oriented perpendicular to the adjacent outer wall panel;

a rectangular inner wall panel hingedly connected to the lateral edge of each of said rectangular spacer panels opposite said respective outer wall panels and positioned parallel to said adjacent outer wall panel between said adjacent pairs of overlapping side wall panels;

spacer tabs hingedly connected to said spacer panels and positioned between said inner and said outer wall panels; and rectangular locking tabs hingedly connected along juxtaposed lateral edges of the perpendicularly oriented inner wall panels and extending diagonally and in face-to-face relationship to the inner corner formed by the hinge line connected said outer wall panels.

* * * * *